US012232596B2

(12) United States Patent
Brown

(10) Patent No.: US 12,232,596 B2
(45) Date of Patent: Feb. 25, 2025

(54) HOT TOOL POUCH ASSEMBLY

(71) Applicant: Erica Brown, Indianapolis, IN (US)

(72) Inventor: Erica Brown, Indianapolis, IN (US)

( * ) Notice: Subject to any disclaimer, the term of this patent is extended or adjusted under 35 U.S.C. 154(b) by 171 days.

(21) Appl. No.: 18/112,092

(22) Filed: Feb. 21, 2023

(65) Prior Publication Data

US 2024/0277132 A1 Aug. 22, 2024

(51) Int. Cl.
*A45F 3/00* (2006.01)
*A45D 44/02* (2006.01)

(52) U.S. Cl.
CPC ..... *A45F 3/005* (2013.01); *A45D 44/02* (2013.01); *A45F 2003/003* (2013.01)

(58) Field of Classification Search
CPC .... A45F 3/005; A45F 2003/003; A45D 44/02
USPC ..... 224/673
See application file for complete search history.

(56) References Cited

U.S. PATENT DOCUMENTS 2,011,245 A * 8/1935 Horne ..... C10L 5/34 44/550
3,730,374 A * 5/1973 Picciano ..... B65D 81/3823 220/592.15
4,836,428 A * 6/1989 Evans ..... A45C 1/04 224/679
5,141,189 A 8/1992 Andrew
5,577,607 A 11/1996 Drake
6,612,350 B1 * 9/2003 Brynjulfsen ..... A45C 13/10 224/231
6,808,066 B2 * 10/2004 Bean ..... A45D 1/00 206/349
7,114,190 B2 10/2006 Najarian
D540,981 S 4/2007 Rosdal
D542,467 S * 5/2007 Martin ..... D28/38
7,337,902 B2 * 3/2008 Rosdal ..... A45D 6/00 220/666
8,585,753 B2 * 11/2013 Scanlon ..... B29C 55/26 623/1.42
D711,043 S * 8/2014 Cooper ..... D28/38
D891,757 S * 8/2020 Dalton ..... D3/205
10,925,379 B1 * 2/2021 Fulbrook ..... A45C 13/02
2011/0091621 A1 * 4/2011 Hering ..... A47J 37/0885 99/449
2012/0160884 A1 * 6/2012 Levine ..... A45C 3/045 224/148.5
2012/0286012 A1 11/2012 Flis
2017/0150806 A1 * 6/2017 Schneider ..... A45F 5/021
2019/0200806 A1 * 7/2019 Borovicka ..... B65D 81/3407

FOREIGN PATENT DOCUMENTS

WO WO2015005911 1/2015

* cited by examiner

*Primary Examiner* — Nathan J Newhouse
*Assistant Examiner* — Lester L Vanterpool

(57) ABSTRACT

A hot tool pouch assembly includes a waist belt that can be worn around the user's waist. A pouch is provided with a channel and the waist belt is insertable through the channel for wearing the pouch on the user's waist. The pouch is comprised of a heat resistant material to store a hot tool without is burned. A mesh cage is positioned in the pouch to facilitate the hot tool to be stored in the pouch. A liner is positioned in the mesh cage and the liner is comprised of a heat resistant material to facilitate the hot tool to be stored in the pouch. An insert is insertable into the mesh cage and the insert is comprised of a heat resistant material to facilitate the hot tool to be stored in the pouch.

6 Claims, 6 Drawing Sheets

HOT TOOL POUCH ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to tool pouch devices and more particularly pertains to a new tool pouch device for storing a hot tool without being burned. The device includes a cup, a wrapping around the cup and a mesh cage positioned in the cup. The device includes a liner positioned in the mesh cage and an insert positioned in the liner. Each of the liner and the insert are comprised of a heat resistant material for storing a hot tool.

(2) Description of Related Art including information disclosed under 37 CFR 1.97 and 1.98.

The prior art relates to tool pouch devices including a clip that is positionable around a hot tool. The prior art discloses a heat resistant pouch for storing a hot tool which includes a closure. The prior art discloses a variety of pouches for storing hot tools which are comprised of a heat resistant material. The prior art discloses a tool pouch that includes a plurality of holders attached to a waist belt for containing cosmetology tools. The prior art discloses a variety of tool sleeve devices that are comprised of a heat resistant material for storing a hot tool.

BRIEF SUMMARY OF THE INVENTION

An embodiment of the disclosure meets the needs presented above by generally comprising a waist belt that can be worn around the user's waist. A pouch is provided with a channel and the waist belt is insertable through the channel for wearing the pouch on the user's waist. The pouch is comprised of a heat resistant material to store a hot tool without is burned. A mesh cage is positioned in the pouch to facilitate the hot tool to be stored in the pouch. A liner is positioned in the mesh cage and the liner is comprised of a heat resistant material to facilitate the hot tool to be stored in the pouch. An insert is insertable into the mesh cage and the insert is comprised of a heat resistant material to facilitate the hot tool to be stored in the pouch.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
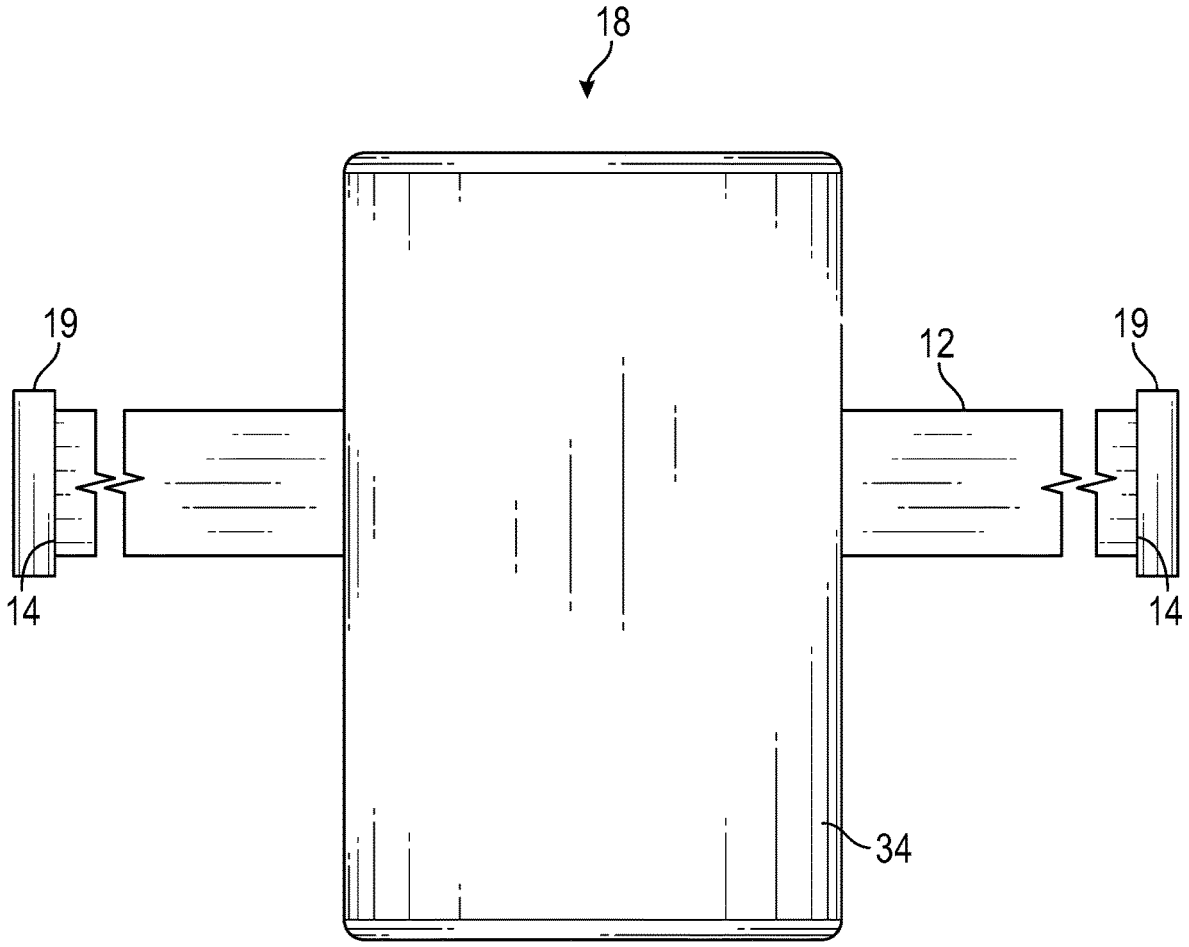
FIG. 1 is a front view of a hot tool pouch assembly according to an embodiment of the disclosure.
Figure 2:
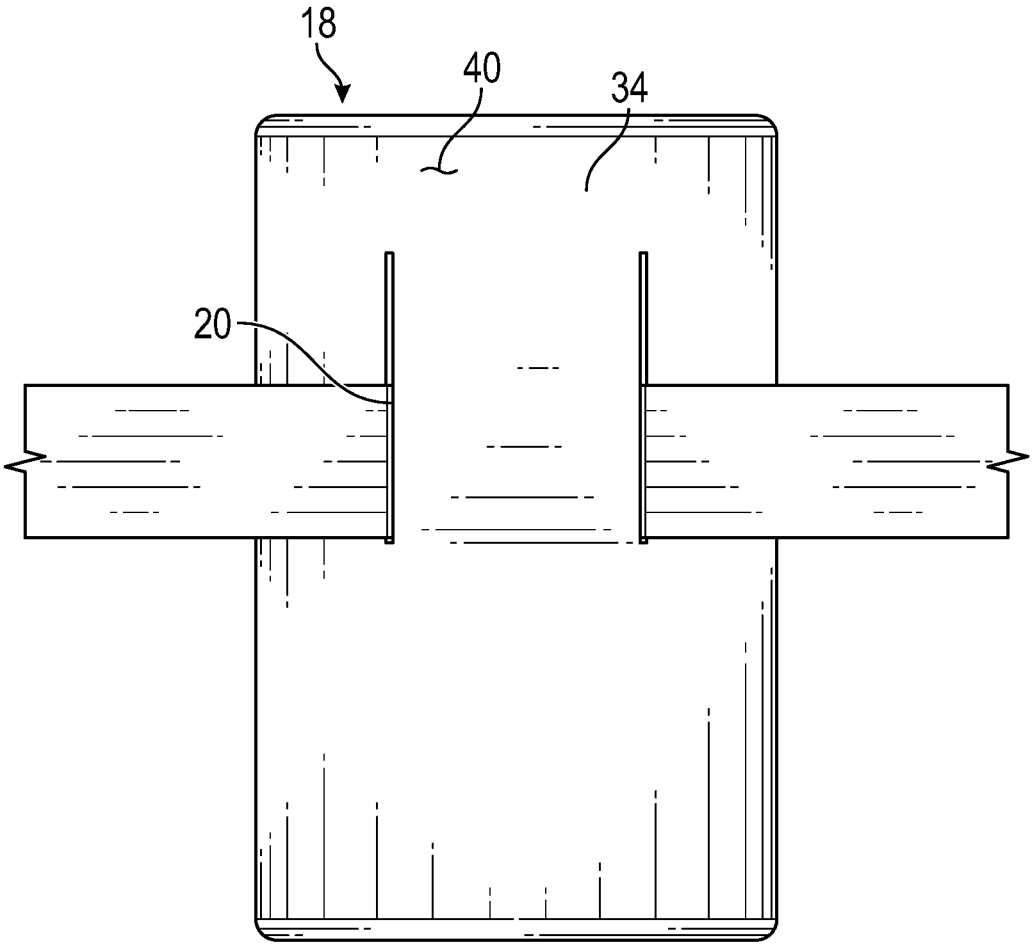
FIG. 2 is a back view of an embodiment of the disclosure.
Figure 3:
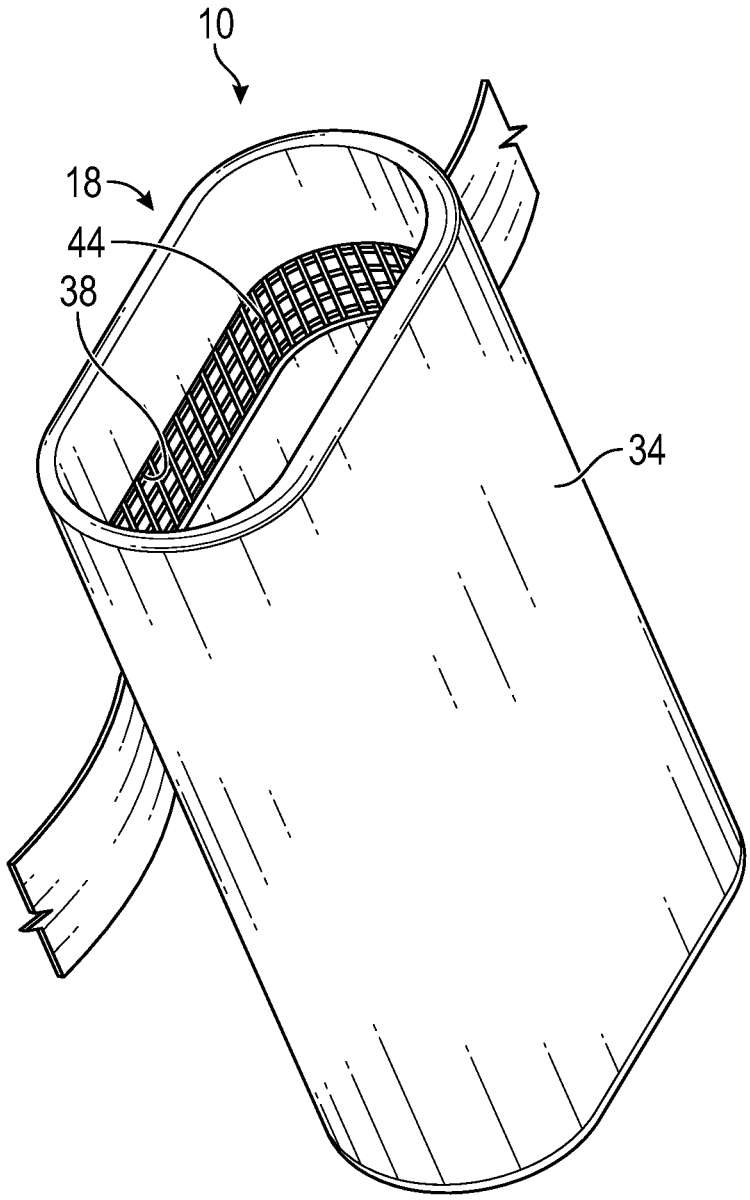
FIG. 3 is a top perspective view of an embodiment of the disclosure.
Figure 4:
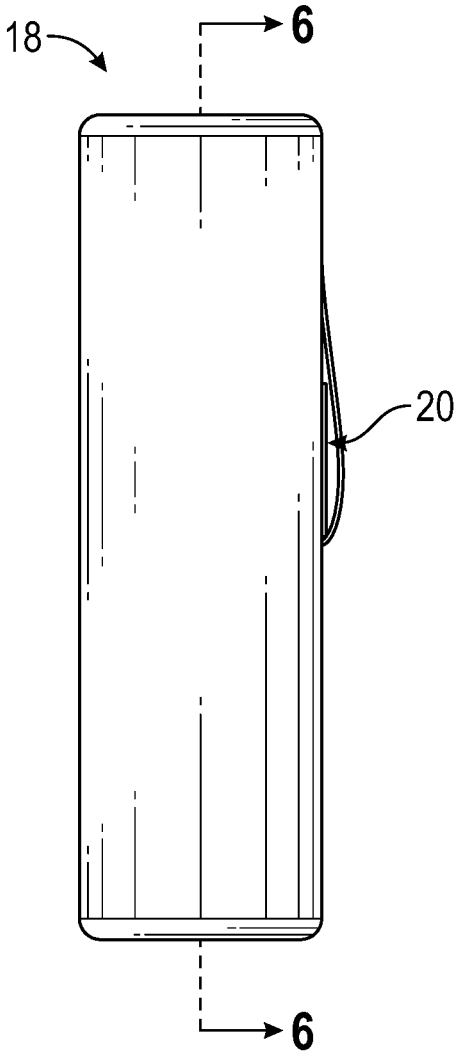
FIG. 4 is a left side view of an embodiment of the disclosure.
Figure 5:
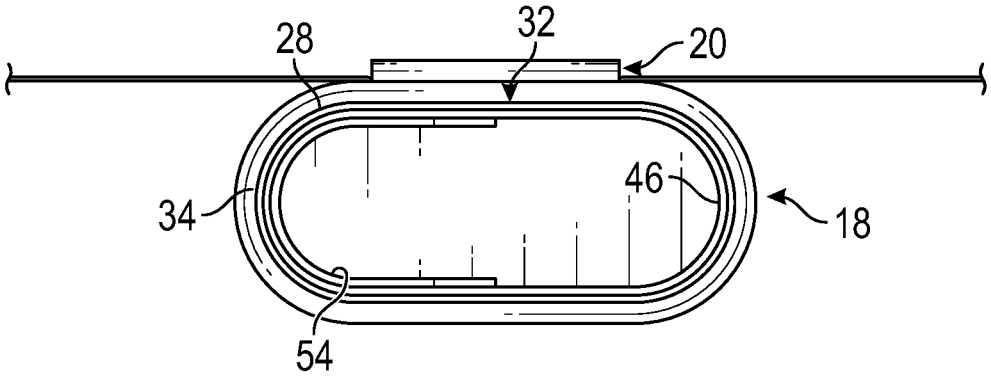
FIG. 5 is a top view of an embodiment of the disclosure.
Figure 6:
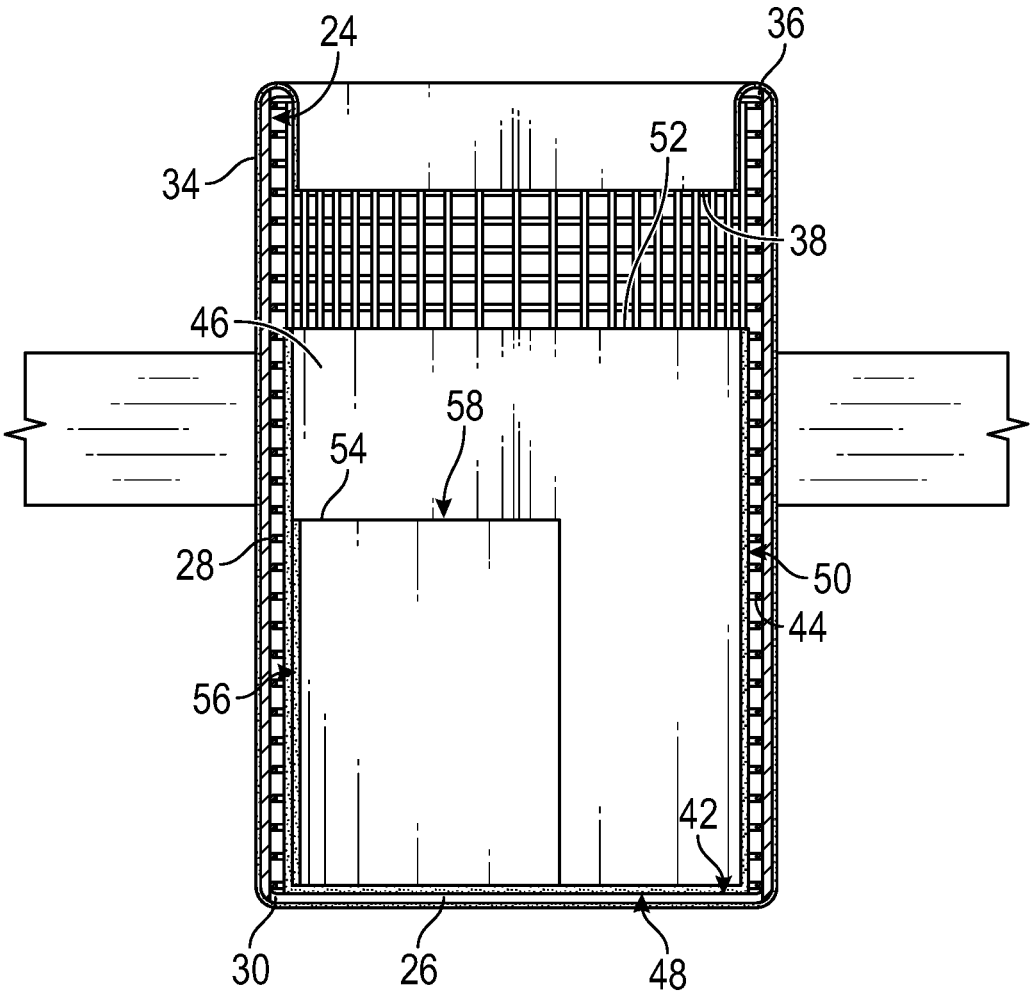
FIG. 6 is a cross sectional view taken along line 6-6 of FIG. 4 of an embodiment of the disclosure.
Figure 7:
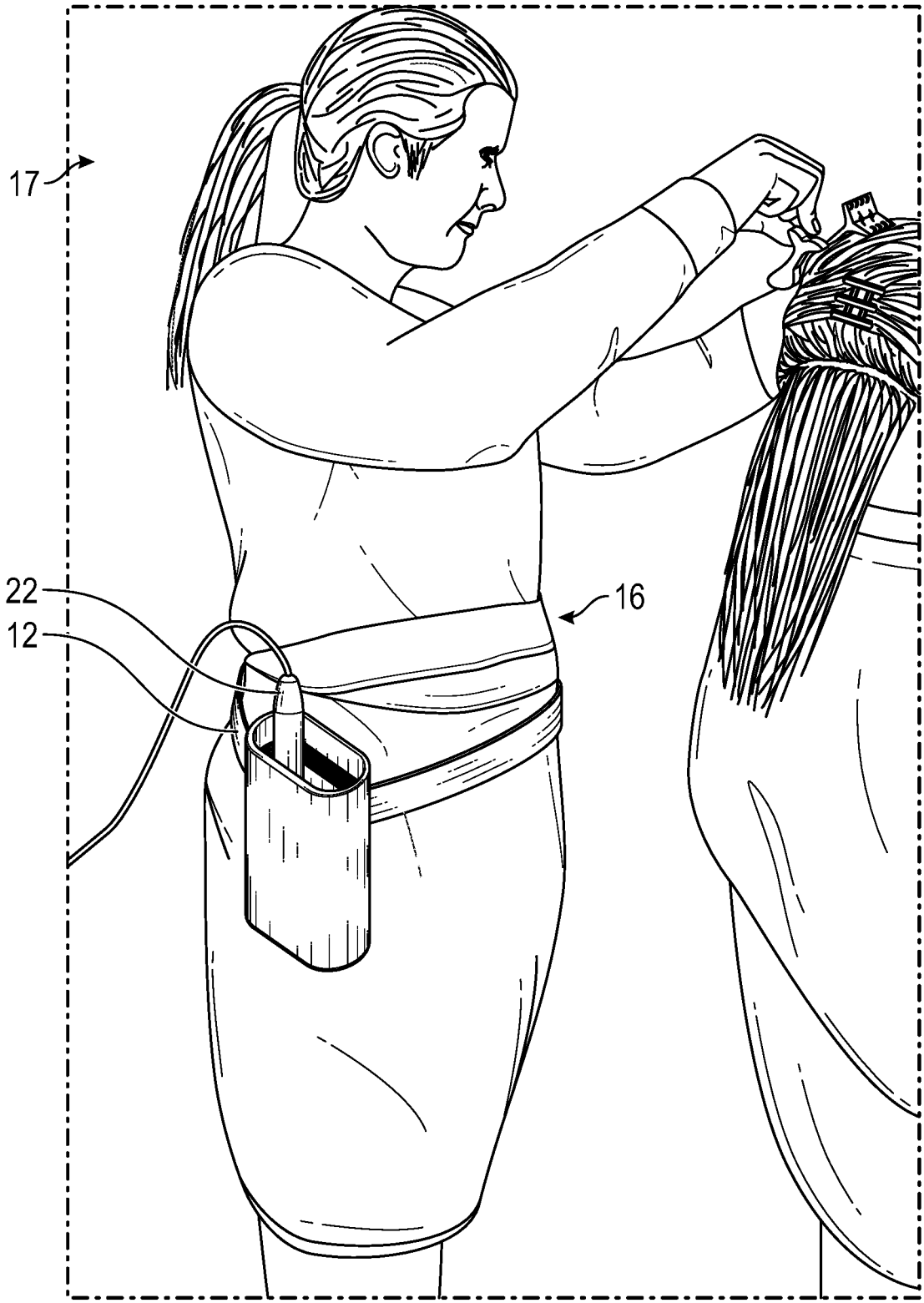
FIG. 7 is a perspective in-use view of an embodiment of the disclosure.

With reference now to the drawings, and in particular to FIGS. 1 through 7 thereof, a new tool pouch device embodying the principles and concepts of an embodiment of the disclosure and generally designated by the reference numeral 10 will be described.

As best illustrated in FIGS. 1 through 7, the hot tool pouch assembly 10 generally comprises a waist belt 12 which has a pair of ends 14 that are matable to each other thereby facilitating the waist belt 12 be worn around a waist 16 of a user 17. As is shown in FIG. 1, a pair of couplers 19 may each be attached to a respective one of the ends 14 and the couplers 19 are matable together. The couplers 19 may comprise a pair of buckles, complementary fasteners or other typical means of securing a waist belt around a user. A pouch 18 is provided that has a channel 20 extending through the pouch 18 and the waist belt 12 is insertable through the channel 20 such that the pouch 18 can be suspended on the user's waist 16. The pouch 18 is comprised of a heat resistant material to store a hot tool 22 without being burned thereby facilitating the user 17 to store the hot tool 22 between periods of use in an easily accessible location. The hot tool 22 may be an electric curling iron, an electric hair straightener or any other heated tool commonly employed in the cosmetology industry and the user 17 may be a cosmetologist.

The pouch 18 comprises a cup 24 that has a bottom wall 26 and an outer wall 28 extending upwardly from a perimeter 30 of the bottom wall 26. The bottom wall 26 is elongated along a longitudinal axis such that the cup 24 has an ovoid shape defining a first side 32 of the outer wall 28. Furthermore, the cup 24 is comprised of a thermally resistant material, including but not being limited to, plastic, rubber or polyvinylchloride. The pouch 18 includes a wrapping 34 that is wrapped around the bottom wall 26 and the outer wall 28 of the cup 24. The wrapping 34 is folded over a top edge 36 of the outer wall 28 of the cup 24 such that the wrapping 34 extends downwardly into the cup 24 having an upper edge 38 of the wrapping 34 being spaced from the top edge 36 of the outer wall 28 of the cup 24.

The wrapping 34 is comprised of an abrasion resistant material, including but not being limited to, leather or canvas. The channel 20 is integrated into an outer surface 40 of the wrapping 34 and the channel 20 is positioned closer to the top edge 36 of the outer wall 28 of the cup 24 than the bottom wall 26 of the cup 24. The channel 20 is oriented to extend along an axis that is oriented parallel with a top surface 42 of the bottom wall 26 thereby facilitating the cup 24 to be oriented perpendicular to the waist belt 12 when the waist belt 12 is extended through the channel 20. A mesh cage 44 is positioned in the pouch 18 and the mesh cage 44 is comprised of a thermally resistant material, including but not being limited to, steel or aluminum, to facilitate the hot tool 22 to be stored in the pouch 18. The mesh cage 44 conforms to the outer wall 28 of the cup 24 and the bottom wall 26 of the cup 24. Furthermore, the wrapping 34 is folded over the mesh cage 44 at the top edge 36 of the outer wall 28 of the cup 24 having the wrapping 34 extending downwardly along the mesh cage 44.

A liner 46 is positioned in the mesh cage 44 having the liner 46 extending around a full circumference of the mesh cage 44. The liner 46 is comprised of a heat resistant material, including but not being limited to, rubber or silicone, to facilitate the hot tool 22 to be stored in the pouch 18. Furthermore, the liner 46 may be capable of resisting temperatures of up to 450.0 degrees Fahrenheit without deforming or discoloring. The liner 46 has a lower wall 48 and an outside wall 50 and the lower wall 48 rests on the bottom wall 26 of the cup 24. The outside wall 50 extends around a full circumference of the mesh cage 44. The liner 46 has a topmost edge 52 that is positioned between the upper edge 38 of the wrapping 34 and the top edge 36 of the outer wall 28 of the cup 24.

An insert 54 is insertable into the liner 46 having the insert 54 curving around a substantial circumference of the liner 46. The insert 54 is comprised of a heat resistant material, including but not being limited to, rubber or silicone, to facilitate the hot tool 22 to be stored in the pouch 18. The insert may be capable of resisting temperatures of up to 450.0 degrees Fahrenheit. The insert 54 has a rear surface 56 which abuts the outside wall 50 of the liner 46 and the insert 54 rests on the lower wall 48 of the liner 46. Additionally, the insert 54 has a height that is less than a height of the liner 46 such that an uppermost edge 58 of the insert 54 is spaced below the topmost edge 52 of the liner 46.

In use, the waist belt 12 is worn around the user's waist 16 and the hot tool 22 is positioned in the pouch 18. In this way the hot tool 22 can be stored in an easily accessible location while the hot tool 22 is heating up and in between periods of use. The mesh cage 44, the liner 46 and the insert 54 inhibit the pouch 18 from being damaged by the heat produced by the hot tool 22. Furthermore, the mesh cage 44, the liner 46 and the insert 54 inhibit the user 17 from being burned by the heat produced by the hot tool 22 when the hot tool 22 is stored in the pouch 18. In this way the hot tool 22 can be readily accessible at operating temperature for extended periods of time without having the hot tool 22 occupying space on a counter top, for example, or other horizontal surface.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A hot tool pouch assembly being wearable around a user's waist for storing a hot tool, said assembly comprising:

a waist belt having a pair of ends being matable to each other wherein said waist belt is configured to be worn around the user's waist;

a pouch having a channel extending through said pouch, said waist belt being insertable through said channel wherein said pouch is configured to be suspended on the user's waist, said pouch being comprised of a heat resistant material wherein said pouch is configured to store a hot tool without being burned thereby facilitating the user to store the hot tool between periods of use in an easily accessible location;

a mesh cage being positioned in said pouch, said mesh cage being comprised of a thermally resistant material wherein said mesh cage is configured to facilitate the hot tool to be stored in said pouch;

a liner being positioned in said mesh cage having said liner extending around a full circumference of said mesh cage, said liner being comprised of a heat resistant material wherein said liner is configured to facilitate the hot tool to be stored in said pouch; and an insert being insertable into said mesh cage having said insert curving around a substantial perimeter of said mesh cage, said insert being comprised of a heat resistant material wherein said insert is configured to facilitate the hot tool to be stored in said pouch.

2. The assembly according to claim 1, wherein said pouch comprises:

a cup having a bottom wall and an outer wall extending upwardly from a perimeter of said bottom wall, said bottom wall being elongated along a longitudinal axis such that said cup has an ovoid shape defining a first side of said outer wall, said cup being comprised of a thermally resistant material; and a wrapping being wrapped around said bottom wall and said outer wall of said cup, said wrapping being folded over a top edge of said outer wall of said cup such that said wrapping extends downwardly into said cup having an upper edge of said wrapping being spaced from said top edge of said outer wall of said cup, said wrapping being comprised of an abrasion resistant material.

3. The assembly according to claim 2, wherein said channel is integrated into an outer surface of said wrapping, said channel being positioned closer to said top edge of said outer wall of said cup than said bottom wall of said cup, said channel being oriented to extend along an axis being oriented parallel with a top surface of said bottom wall thereby facilitating said cup to be oriented perpendicular to said waist belt when said waist belt is extended through said channel.

4. The assembly according to claim 2, wherein said mesh cage conforms to said outer wall of said cup and said bottom wall of said cup, said wrapping being folded over said mesh cage at said top edge of said outer wall of said cup having said wrapping extending downwardly along said mesh cage.

5. The assembly according to claim 2, wherein said insert has a rear surface which abuts said mesh cage, said insert resting on said lower wall of said liner.

6. A hot tool pouch assembly being wearable around a user's waist for storing a hot tool, said assembly comprising:

a waist belt having a pair of ends being matable to each other wherein said waist belt is configured to be worn around the user's waist;

a pouch having a channel extending through said pouch, said waist belt being insertable through said channel wherein said pouch is configured to be suspended on the user's waist, said pouch being comprised of a heat resistant material wherein said pouch is configured to store a hot tool without being burned thereby facilitating the user to store the hot tool between periods of use in an easily accessible location, said pouch comprising:

a cup having a bottom wall and an outer wall extending upwardly from a perimeter of said bottom wall, said bottom wall being elongated along a longitudinal axis such that said cup has an ovoid shape defining a first side of said outer wall, said cup being comprised of a thermally resistant material; and a wrapping being wrapped around said bottom wall and said outer wall of said cup, said wrapping being folded over a top edge of said outer wall of said cup such that said wrapping extends downwardly into said cup having an upper edge of said wrapping being spaced from said top edge of said outer wall of said cup, said wrapping being comprised of an abrasion resistant material, said channel being integrated into an outer surface of said wrapping, said channel being positioned closer to said top edge of said outer wall of said cup than said bottom wall of said cup, said channel being oriented to extend along an axis being oriented parallel with a top surface of said bottom wall thereby facilitating said cup to be oriented perpendicular to said waist belt when said waist belt is extended through said channel;

a mesh cage being positioned in said pouch, said mesh cage being comprised of a thermally resistant material wherein said mesh cage is configured to facilitate the hot tool to be stored in said pouch, said mesh cage conforming to said outer wall of said cup and said bottom wall of said cup, said wrapping being folded over said mesh cage at said top edge of said outer wall of said cup having said wrapping extending downwardly along said mesh cage;

a liner being positioned in said mesh cage having said liner extending around a full circumference of said mesh cage, said liner being comprised of a heat resistant material wherein said liner is configured to facilitate the hot tool to be stored in said pouch, said liner having a lower wall and an outside wall, said lower wall resting on said bottom wall of said cup, said outside wall extending around a full circumference of said mesh cage, said liner having a topmost edge being positioned between said upper edge of said wrapping and said top edge of said outer wall of said cup; and an insert being insertable into said liner having said insert curving around a substantial circumference of said liner, said insert being comprised of a heat resistant material wherein said insert is configured to facilitate the hot tool to be stored in said pouch, said insert having a rear surface which abuts said outside wall of said liner, said insert resting on said lower wall of said liner.

* * * * *